US008057224B2

(12) United States Patent
Knoepfel

(10) Patent No.: US 8,057,224 B2
(45) Date of Patent: Nov. 15, 2011

(54) PREMIX BURNER WITH MIXING SECTION

(75) Inventor: Hans Peter Knoepfel, Dottikon (CH)

(73) Assignee: ALSTOM Technology Ltd., Baden (CH)

( * ) Notice: Subject to any disclaimer, the term of this patent is extended or adjusted under 35 U.S.C. 154(b) by 563 days.

(21) Appl. No.: 11/763,603

(22) Filed: Jun. 15, 2007

(65) Prior Publication Data

US 2007/0259296 A1 Nov. 8, 2007

Related U.S. Application Data

(63) Continuation of application No. PCT/EP2005/056168, filed on Nov. 23, 2005.

(30) Foreign Application Priority Data

Dec. 23, 2004 (CH) ..... 2145/04

(51) Int. Cl.
*F23D 17/00* (2006.01)
*F23D 14/62* (2006.01)
*F23C 5/00* (2006.01)

(52) U.S. Cl. ..... 431/354; 431/350; 431/8; 431/9; 431/10

(58) Field of Classification Search ..... 431/350, 431/353, 8, 9, 10, 354; 60/722, 733, 737, 60/738

See application file for complete search history.

(56) References Cited

U.S. PATENT DOCUMENTS 2,647,568 A * 8/1953 Sloan ..... 431/183
4,867,674 A * 9/1989 Keller et al. ..... 431/351
5,375,995 A * 12/1994 Dobbeling et al. ..... 431/8
5,482,457 A * 1/1996 Aigner et al. ..... 431/351
5,588,826 A * 12/1996 Dobbeling et al. ..... 431/354
5,626,017 A * 5/1997 Sattelmayer ..... 60/723
5,645,410 A * 7/1997 Brostmeyer ..... 431/10
5,673,551 A * 10/1997 Dobbeling ..... 60/776
5,685,705 A 11/1997 Knoepfel (Continued)

FOREIGN PATENT DOCUMENTS

DE 4409918 A1 * 9/1995

(Continued)

OTHER PUBLICATIONS

Correa, S. M., "A Review of NOx Formation Under Gas-Turbine Combustion Conditions," Combust. Sci. and Tech., 1992, pp. 329-362, vol. 87, Gordon and Breach Science Publishers S.A., United Kingdom.

(Continued)

*Primary Examiner* — Carl Price

(74) *Attorney, Agent, or Firm* — Cermak Nakajima LLP; Adam J. Cermak

(57) ABSTRACT

A premix burner has a mixing section (3) for a heat generator, sectional conical shells (5) which complement one another to form a swirl body, enclose a conically widening swirl space (6), and mutually define tangential air-inlet slots (7), along which feeds (8) for gaseous fuel are provided in a distributed manner, having at least one fuel feed (11) for liquid fuel, this fuel feed (11) being arranged along a burner axis (A) passing centrally through the swirl space (6), and having a mixing tube (4) adjoining the swirl body downstream via a transition piece (2). At least one additional fuel feed (13) for liquid fuel is provided in the region of the swirl body, the transition piece (2), and/or the mixing tube (4).

11 Claims, 5 Drawing Sheets

U.S. PATENT DOCUMENTS

| | | | | | |
|---|---|---|---|---|---|
| 5,833,451 | A | * | 11/1998 | McMillan | 431/350 |
| 5,895,211 | A | * | 4/1999 | McMillan | 431/10 |
| 5,954,495 | A | * | 9/1999 | Knopfel et al. | 431/285 |
| 6,045,351 | A | * | 4/2000 | Dobbeling et al. | 431/8 |
| 6,142,665 | A | * | 11/2000 | Haffner et al. | 374/144 |
| 6,152,726 | A | * | 11/2000 | Ruck et al. | 431/284 |
| 6,183,240 | B1 | * | 2/2001 | Dobbeling et al. | 431/10 |
| 6,331,109 | B1 | * | 12/2001 | Paikert et al. | 431/350 |
| 6,461,151 | B1 | | 10/2002 | Knoepfel et al. | |
| 6,558,154 | B2 | * | 5/2003 | Eroglu et al. | 431/8 |
| 6,599,121 | B2 | * | 7/2003 | Gutmark et al. | 431/182 |
| 6,625,988 | B2 | * | 9/2003 | Weisenstein et al. | 60/777 |
| 6,640,545 | B2 | | 11/2003 | Ruck et al. | |
| 6,679,061 | B2 | * | 1/2004 | Steinbach et al. | 60/777 |
| 6,688,111 | B2 | * | 2/2004 | Stalder et al. | 60/776 |
| 6,691,518 | B2 | * | 2/2004 | Doebbeling et al. | 60/776 |
| 6,694,745 | B2 | | 2/2004 | Stalder et al. | |
| 6,702,574 | B1 | * | 3/2004 | Dobbeling | 431/350 |
| 6,895,759 | B2 | | 5/2005 | Knoepfel | |
| 7,003,957 | B2 | * | 2/2006 | Griffin et al. | 60/737 |
| 7,140,183 | B2 | * | 11/2006 | Ruck et al. | 60/737 |
| 7,445,445 | B2 | * | 11/2008 | Eroglu et al. | 431/350 |
| 2003/0093997 | A1 | | 5/2003 | Stalder et al. | |
| 2004/0018459 | A1 | | 1/2004 | Ruck et al. | |
| 2004/0226297 | A1 | * | 11/2004 | Griffin et al. | 60/737 |
| 2007/0099142 | A1 | * | 5/2007 | Flohr et al. | 431/354 |

FOREIGN PATENT DOCUMENTS

| | | | | |
|---|---|---|---|---|
| DE | GB 2 289 326 | | * | 11/1995 |
| DE | 4444125 | A1 | * | 6/1996 |
| DE | 19527453 | A1 | * | 1/1997 |
| DE | 196 26 240 | | * | 1/1998 |
| EP | 0321809 | | | 6/1989 |
| EP | 625673 | A2 | * | 11/1994 |
| EP | 694740 | | * | 4/1996 |
| EP | 0704657 | | | 4/1996 |
| EP | 713058 | A1 | * | 5/1996 |
| EP | 801268 | | * | 3/1997 |
| EP | 1207350 | A2 | * | 5/2002 |
| GB | 2345958 | A | * | 7/2000 |
| GB | 2398375 | A | * | 8/2004 |
| JP | 09327641 | A | * | 12/1997 |
| JP | 11223305 | A | * | 8/1999 |
| WO | WO 03036167 | A1 | * | 5/2003 |
| WO | WO2006/069861 | | | 7/2006 |

OTHER PUBLICATIONS

Search Report for Swiss Patent App. No. 2145/04 (Apr. 19, 2005).
International Search Report for PCT Patent App. No. PCT/EP2005/056168 (Mar. 17, 2006).
Internatonal Preliminary Report on Patentability for PCT Patent App. No. PCT/EP2005/056168 (Apr. 11, 2007).

* cited by examiner

PREMIX BURNER WITH MIXING SECTION

This application is a Continuation of, and claims priority under 35 U.S.C. §120 to, International application number PCT/EP2005/056168, filed 23 Nov. 2005, and claims priority therethrough under 35 U.S.C. §119 to Swiss application number 02145/04, filed 23 Dec. 2004, the entireties of both of which are incorporated by reference herein.

BACKGROUND

1. Field of Endeavor

The invention relates to a premix burner having a mixing section for a heat generator, preferably for a combustion chamber for operating a gas turbine plant, having sectional conical shells which complement one another to form a swirl body, enclose a conically widening swirl space and mutually define tangential air-inlet slots, along which feeds for gaseous fuel are provided in a distributed manner, having at least one fuel feed for liquid fuel, this fuel feed being arranged along a burner axis passing centrally through the swirl space, and having a mixing tube adjoining the swirl body downstream via a transition piece.

2. Brief Description of the Related Art

Premix burners of the generic type have been successfully used for many years for the firing of combustion chambers for driving gas turbine plants and constitute largely perfected components with regard to their burner characteristics. Depending on use and desired burner outputs, premix burners of the generic type are available which are optimized both with regard to burner output and from the aspect of reduced pollutant emission.

A premix burner without a mixing tube, which premix burner is to be briefly referred to on account of the development history, can be gathered from EP 0 321 809 B1 and essentially includes two hollow, conical sectional bodies which are nested one inside the other in the direction of flow and whose respective longitudinal symmetry axes run offset from one another, so that the adjacent walls of the sectional bodies form tangential slots in their longitudinal extent for a combustion air flow. Liquid fuel is normally sprayed via a central nozzle into the swirl space enclosed by the sectional bodies, whereas gaseous fuel is introduced via the further nozzles present in longitudinal extent in the region of the tangential air-inlet slots.

The burner concept of the foregoing premix burner is based on the generation of a closed swirl flow inside the conically widening swirl space. However, on account of the increasing swirl in the direction of flow inside the swirl space, the swirl flow becomes unstable and turns into an annular swirl flow having a backflow zone in the flow core. The location at which the swirl flow, due to breakdown, turns into an annular swirl flow having a backflow zone, with a "backflow bubble" being formed, is essentially determined by the cone angle which is inscribed by the sectional conical shells, and by the slot width of the air-inlet slots. In principle, during the selection for dimensioning, the slot width and the cone angle, which ultimately determines the overall length of the burner, narrow limits are imposed, so that a desired flow zone can arise which leads to the formation of a swirl flow which breaks down in the burner orifice region into an annular swirl flow while forming a spatially stable backflow zone in which the fuel/air mixture ignites while forming a spatially stable flame. A reduction in the size of the air-inlet slots leads to an upstream displacement of the backflow zone, as a result of which, however, the mixture of fuel and air is ignited sooner and further upstream.

On the other hand, in order to position the backflow zone further downstream, i.e., in order to obtain a longer premix or evaporation section, a mixing section, transmitting the swirl flow, in the form of a mixing tube is provided downstream of the swirl body as described in detail, for example, in EP 0 704 657 B1. Disclosed in that publication is a swirl body which consists of four conical sectional bodies and adjoining which downstream is a mixing section serving for further intermixing of the fuel/air mixture. For the continuous transfer of the swirl flow, discharging from the swirl body, into the mixing section, transition passages running in the direction of flow are provided between the swirl body and the mixing section, these transition passages serving to transfer the swirl flow formed in the swirl body into the mixing section arranged downstream of the transition passages.

However, the provision of a mixing tube inevitably reduces the size of the backflow bubble, especially since the swirl of the flow is to be selected in such a way that the flow does not break down inside the mixing tube. The swirl is consequently too small at the end of the mixing tube for a large backflow bubble to be able to form. Even tests for enlarging the backflow bubble in which the inner contour of the mixing tube provides a diffuser angle opening in a divergent manner in the direction of flow showed that such measures lead to the upstream drifting of the flame. Furthermore, additional problems arise with regard to flow separations close to the wall along the mixing tube, these flow separations having an adverse effect on the intermixing of the fuel/air mixture.

In addition to the mechanical design of the burner, the feeding of fuel also has a decisive effect on the flow dynamics of the swirl flow forming inside the swirl body and of the backflow bubble forming as far as possible in a stable manner in the space downstream of the swirl body. Thus, a rich fuel/air mixture forming along the burner axis is found during typical feeding of liquid fuel along the burner axis at the location of the cone tip of the conically widening swirl space, in particular in premix burners of a larger type of construction, as a result of which the risk of "flashback" into the region of the swirl flow increases. Such flashbacks firstly lead inevitably to increased $NO_X$ emissions, especially since the fully intermixed portions of the fuel/air mixture are burned as a result. Secondly, flashback phenomena in particular are dangerous and are therefore to be avoided since they may lead to thermal and mechanical loads and consequently to irreversible damage to the structure of the premix burner.

A further very important, environmental aspect relates to the emission behavior of such premix burners. It is known from various publications, for example from Combust. Sci. and Tech. 1992, Vol. 87, pp. 329-362, that, although the size of the backflow bubble in the case of a perfectly premixed flame has no effect on the $NO_X$ emissions, it is able to considerably influence the CO, UHC emissions and the extinction limit; i.e., the larger the backflow zone, the lower the CO, UHC emissions and the extinction limit. With a flame stabilization zone or backflow bubble forming to a greater extent, a larger load range in the premix burner can therefore be covered, especially since the flame is extinguished at far lower temperatures than in the case of a small backflow bubble. The reasons for this are the heat exchange between the backflow bubble and the ignitable fuel/air mixture and also the stabilization of the flame front in the flow zone.

The above comments show that a variation in output in the sense of an increase in output of a gas turbine plant merely by scaling up the overall size of a hitherto known premix burner leads to a multiplicity of problems and thus inevitably necessitates a completely new design of a conically designed premix burner known up to now. It is necessary to provide a remedy here and to search for measures in order to also permit desired scaling of gas turbine plants with the premix burners currently in operation and having a mixing section arranged downstream, and this with only slight constructional changes to existing premix burner systems.

SUMMARY

One of numerous aspects of the present invention includes a premix burner having a downstream mixing section for a heat generator, in particular for firing a combustion chamber for driving a gas turbine plant, having sectional conical shells which complement one another to form a swirl body, enclose a conically widening swirl space and mutually define tangential air-inlet slots, along which feeds for gaseous fuel are provided in a distributed manner, having at least one fuel feed for liquid fuel, this fuel feed being arranged along a burner axis passing centrally through the swirl space, and having a mixing tube adjoining the swirl body downstream via a transition piece, to be developed in such a way that it can be used even in gas turbine plants of larger dimensions, which require a larger burner load, without having to substantially change the design of the premix burner. In particular, despite the measures maximizing the burner output, it is necessary to keep the pollutant emissions caused by the burner as low as possible. Of course, it is also necessary to always ensure the operating safety of a premix burner modified according to the invention and, despite the measures increasing the burner output, to minimize or completely eliminate the increasing risk of backflash phenomena in powerful burner systems.

Another aspect includes a method of operating a premix burner having a downstream mixing section for a heat generator, in particular for firing a combustion chamber for driving a gas turbine plant, which method, despite an increase in the size of the premix burner, enables the flame position to be stabilized, the CO, UHC and $NO_X$ emissions to be reduced, combustion chamber pulsations to be reduced and the stability range to be increased. In addition, burnout is to be complete.

The features advantageously developing principles of the present invention can be gathered from the description in particular with reference to the exemplary embodiments.

According to yet another aspect of the present invention, a premix burner includes a downstream mixing section, in the form of a mixing tube, is formed by at least one further fuel feed being provided in the region of the swirl body, the transition piece and/or the mixing tube, which fuel feed enables fuel to be fed into the fuel/air mixture radially from outside with respect to the swirl flow forming inside the burner in the direction of flow. With this measure, the radial fuel gradient occurring up to now can be countered, this fuel gradient being caused by an exclusively central fuel feed directed along the burner axis and by the associated formation, close to the burner axis, of a rich fuel/air mixture, which becomes markedly leaner with increasing radial distance from the burner axis. By the additional fuel feed according to principles of the present invention from regions of the burner housing, which radially encloses the fuel/air mixture spreading along the burner axis in the form of a swirl flow, the radial fuel gradient is countered inasmuch as the fuel concentration in the flow regions which are radially remote from the burner axis is increased by metered fuel feed until a desired fuel profile is set along a cross section of flow.

In order to obtain, as far as possible, an axially symmetrical or homogeneous fuel distribution around the burner axis along a cross section of flow within the swirl flow, at least two fuel feed points, preferably a multiplicity of fuel feed points, are to be provided axially symmetrically relative to the burner axis in the respective burner housing regions, whether swirl body, transition piece, and/or mixing tube. The fuel feed points are preferably designed as liquid-fuel nozzles, through which liquid fuel can be discharged while forming a fuel spray. Depending on the desired penetration depth of the fuel feed, the degree of atomization is to be selected by corresponding nozzle contours. At a maximum penetration depth, the fuel nozzle may be designed merely as a hole-type nozzle, through which the fuel is discharged in the form of a fuel spray.

Depending on the region in which the further fuel feeds are provided along the burner axis, the angle relative to the burner axis at which the fuel is introduced radially from outside into the swirl flow is to be selected to be between 90°, i.e., the fuel is introduced perpendicularly to the burner axis, and a larger angle of up to at most 180°, i.e., the fuel is introduced parallel to the burner axis in the direction of the swirl flow.

An additional fuel feed is preferably suitable in the region of the mixing tube, which has an inner wall of rectilinear hollow-cylindrical design or a contoured inner wall like a diffuser structure. In the latter case, it is suitable to provide the additional fuel feeds at the location of the smallest cross section of flow along the mixing tube, i.e., in the region of the greatest axial flow velocity caused by the constriction in the cross section of flow.

Furthermore, tests have been able to confirm that it is possible to optimize the fuel profile along the direction of flow by the premix burner arrangement even in the case of the additional feeding of fuel in the region of the transition piece between swirl generator and mixing tube. In this case, it proved to be especially advantageous to introduce the fuel feed into the axially spreading air/fuel mixture through fuel nozzles pointing perpendicularly to the burner axis. It has been possible to obtain similar good results with a fuel feed in the region of the swirl generator, the additional fuel feed being effected from sides of the sectional conical shells defining the swirl space.

With the measures according to principles of the present invention, compared with the fuel feed practiced up to now, solely from the center of the burner by means of a fuel nozzle which is arranged in the region of the swirl generator and is positioned in the smallest cross section of flow of the swirl generator, the mass flows of the fuel fed to the burner can be adapted for optimizing the burner flow zone. It is thus necessary in particular during the operation of gas turbine plants to adapt the combustion process to the respective load point of the gas turbine plant, i.e., the addition of fuel is to be appropriately selected both via the central fuel nozzle oriented along the burner axis and via the further fuel feeds provided radially around the burner axis in the burner housing in order to obtain as homogeneous a fuel/air mixture as possible in the entire cross section of flow. By means of this at least two-stage fuel feed, i.e., the first stage corresponds to the central fuel feed and the second stage corresponds to the fuel feed directed radially inward into the flow zone, distribution of the fuel can be achieved which is optimally adapted to the respective operating or load point of the gas-turbine plant and which leads to low emissions, lower pulsations and, associated therewith, also to a larger operating range of the burner.

BRIEF DESCRIPTION OF THE DRAWINGS

The invention is described by way of example below, without restricting the general idea of the invention, with reference to exemplary embodiments and the drawings, in which.

DETAILED DESCRIPTION OF EXEMPLARY EMBODIMENTS

Figure 1:
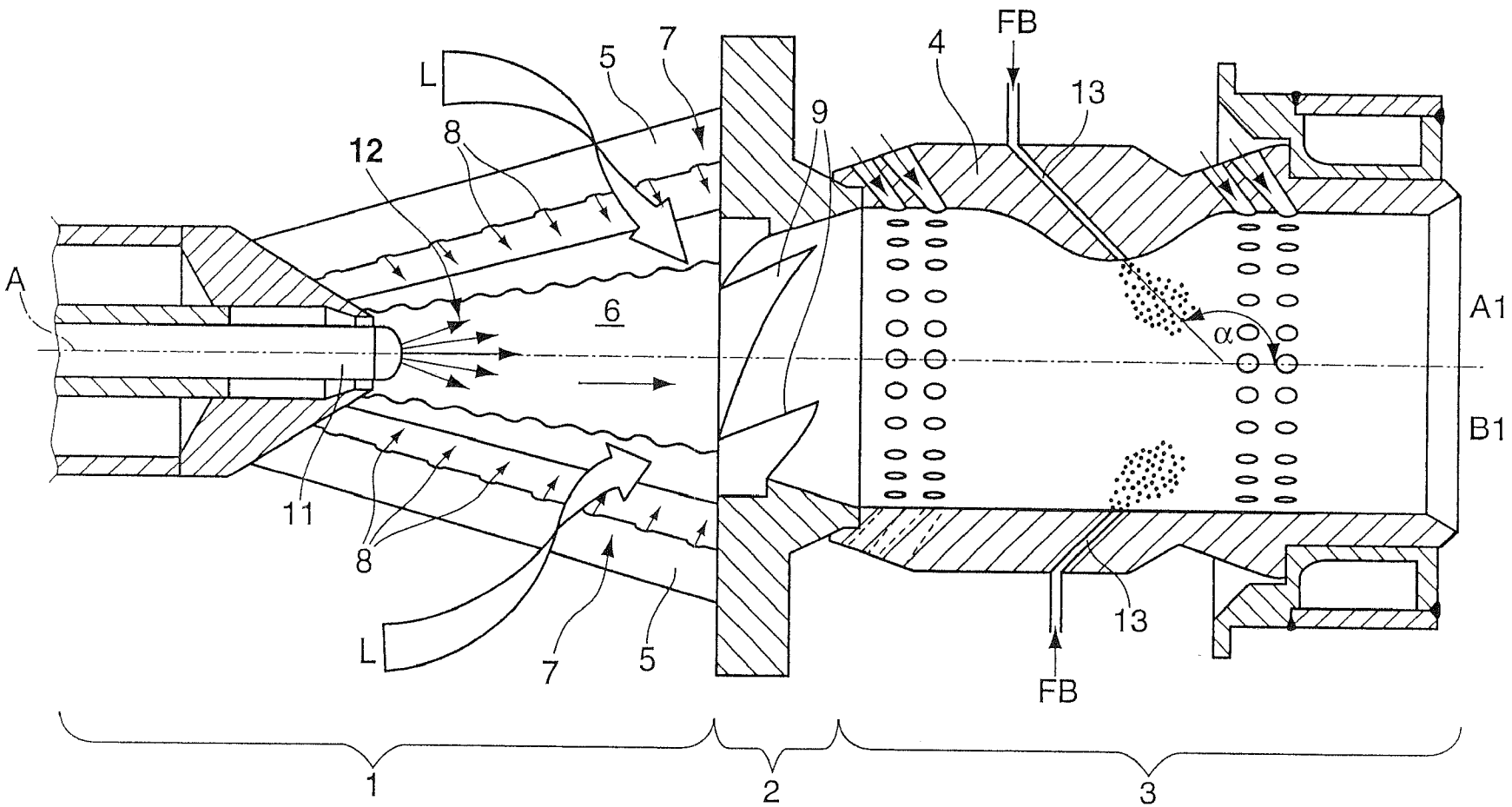
FIG. 1 shows a longitudinal cross section through a burner arrangement having a conically designed premix burner and adjoining mixing tube, with a further liquid-fuel feed, arranged at an angle α relative to the burner axis, in the mixing tube.

FIGS. 1 to 4 show longitudinal cross sections through a burner arrangement having a conically designed premix burner 1, adjoining which downstream along the burner axis A is a transition piece 2, which in turn is connected downstream to a mixing section 3. Not shown in the FIGS. 1 to 4 is a combustion chamber which is to be provided downstream of the mixing section 3 and serves to drive a gas turbine plant.

The premix burner 1 shown in the respective FIGS. 1 to 4 is designed as a double cone burner known per se and defines with two sectional conical shells 5 a swirl space 6 widening conically along the burner axis A in the direction of flow (see arrow illustration). In the region of the smallest internal cross section of the conically widening swirl space 6, a central liquid-fuel nozzle 11 is provided axially relative to the burner axis A, this liquid-fuel nozzle 11 forming a fuel spray 12 spreading largely symmetrically to the burner axis A. Through air-inlet slots 7 which run tangentially to the swirl space 6 and are defined by the two respective sectional conical shells 5, combustion air L having a swirl directed about the burner axis A passes into the swirl space 6 and mixes with gaseous fuel which is discharged from fuel feeds 8 arranged longitudinally in a distributed manner relative to the air-inlet slots 7. The fuel/air mixture which forms in this way inside the swirl space 6 and whose fuel portion is composed of both gaseous and liquid fuel passes in the form of a swirl flow into the mixing section 3 via a transition piece 2 which provides flow guide pieces 9 maintaining or assisting the swirl flow, the mixing section 3 in the simplest case being designed as a mixing tube 4 of hollow-cylindrical design. In all the figures shown, the mixing tube 4, for reasons of a simplified diagrammatic illustration, is shown with two differently designed half planes which each represent different mixing tubes. In the respective top partial cross-sectional half, the mixing tube 4 has a contoured inner wall which is designed like a diffuser having a cross section of flow narrowing in the direction of flow, a smallest cross section of flow and an increasing cross section of flow. In contrast, the bottom half of the mixing tube 4 shown in longitudinal cross-sectional illustration represents a mixing tube having an inner wall of straight-cylindrical design. In order to further differentiate between the respective top and bottom halves of the mixing tube shown in the figures, the mixing tube according to the top half of the illustration is designated by A1, A2, A3, or A4, respectively, whereas the mixing tube according to the bottom embodiment alternative is in each case designated by B1, B2, B3, or B4, respectively.

In the exemplary embodiment according to FIG. 1, a further fuel feed 13 is provided in the region of the mixing tube 4, a fuel FB, for example oil, being fed in through this fuel feed 13 at an angle α relative to the burner axis A. In the case of a mixing tube design according to the top partial cross-sectional illustration A1, the fuel feed 13 opens out at the mixing-tube inner wall in the region of the smallest cross section of flow. In order to obtain as symmetrical a fuel distribution as possible around the burner axis A in the region of the fuel feed 13, at least two fuel feeds 13, preferably a plurality of fuel feeds 13, arranged separately from one another, are to be integrated inside the mixing tube 4. The outlet openings of the individual fuel feeds 13 preferably lie in a common cross-sectional plane which perpendicularly intersects the burner axis A. The fuel feed lines 13 normally open out via conventional hole-type nozzles at the inner wall of the mixing tube 4, but, for optimized fuel feed, may have nozzle outlet contours suitable for producing a very finely atomized fuel spray. Likewise conceivable would be the design of a slotted nozzle which runs around continuously on the inner wall of the mixing tube 4 and through which fuel can be introduced in annular uniform distribution around the burner axis A into the space of the mixing section. The exemplary embodiment in the bottom illustration B1 provides a mixing tube 4 having a straight wall of hollow-cylindrical design, along which fuel is discharged into the interior of the mixing tube 4 likewise at an angle α. The alternative embodiments and arrangements of the fuel feed 13 which are described with respect to the case A1 may also be applied and used in the case of example B1.

Figure 2:
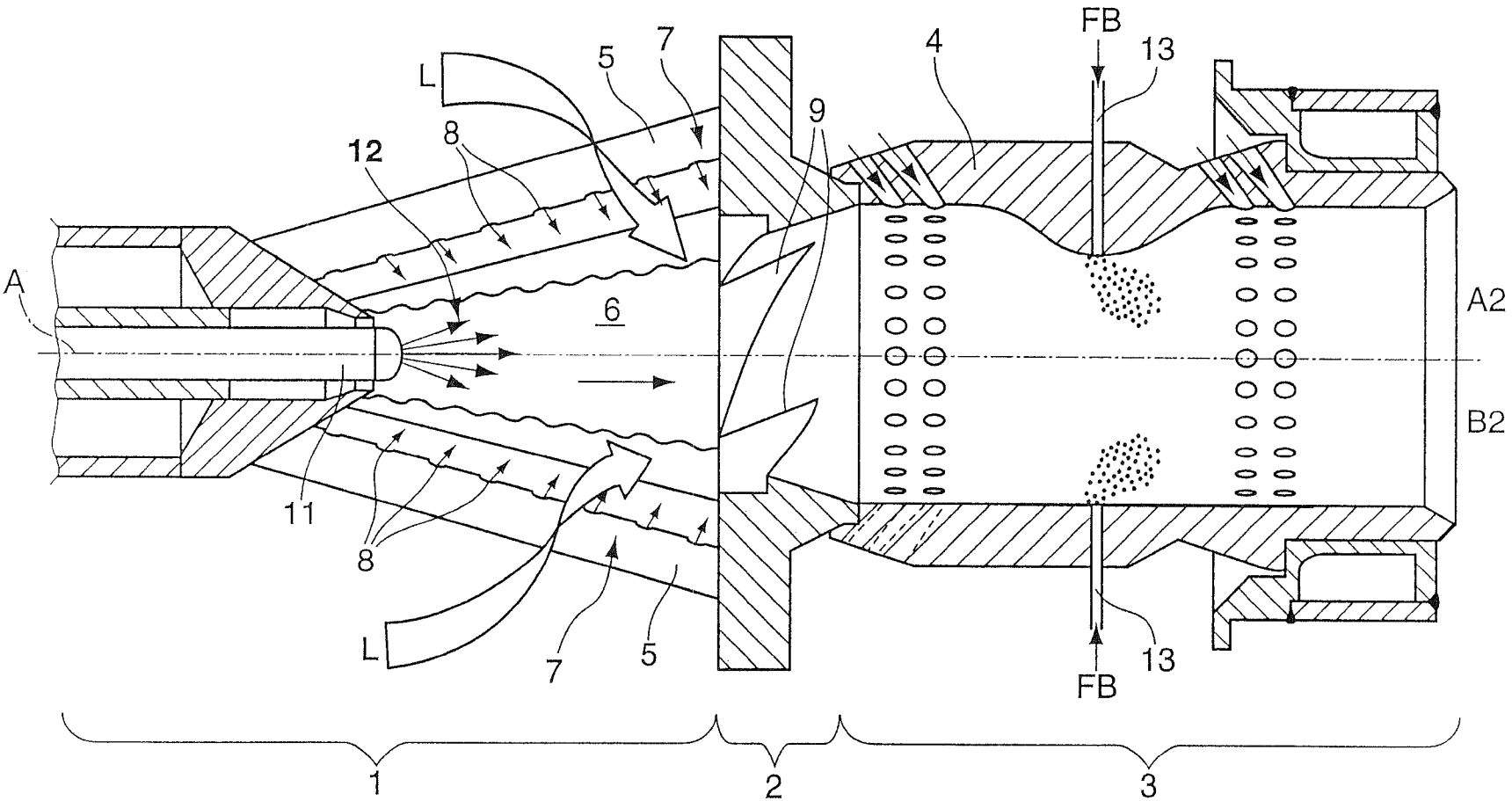
FIG. 2 shows a burner arrangement comparable with the exemplary embodiment according to FIG. 1 but with a liquid-fuel feed oriented perpendicularly to the burner axis, i.e., α=90°.

In the exemplary embodiment according to FIG. 2, the fuel feed 13 in the region of the mixing tube 4 is in each case effected perpendicularly to the burner axis A. In the case of the exemplary embodiment according to A2 in FIG. 2, the fuel feed 13 likewise opens out in the region of the smallest cross section of flow. In case B2, the point at which the fuel feed 13 is effected along the mixing tube is of no importance in principle, but where possible a central position or an axial position upstream relative to the center of the mixing tube is advantageous so that the fed fuel FB is intermixed as completely as possible and a homogeneous fuel/air mixture is formed.

Figure 3:
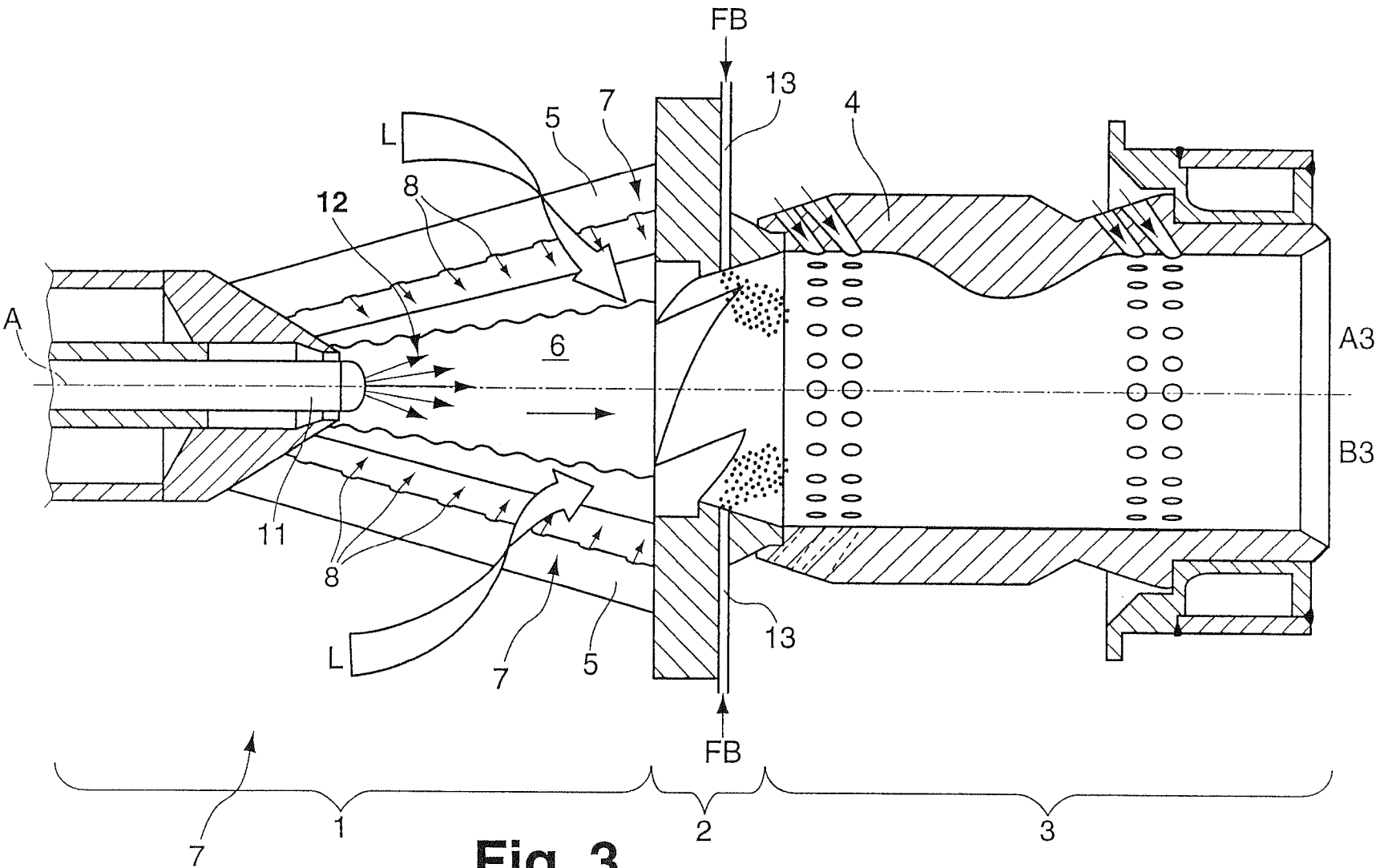
FIG. 3 shows a burner arrangement comparable with the exemplary embodiment according to FIG. 2, but with liquid-fuel feeds integrated in the transition piece.

In the exemplary embodiment according to FIG. 3, the fuel feed 13 is effected in the region of the transition piece 2. In addition to the theoretically possible fuel feed at an angle α greater than 90° relative to the burner axis A, it has proved to be especially advantageous to carry out the fuel feed in this region in each case perpendicularly to the burner axis A, i.e., α=90°, especially since a maximum dwell time of the discharged fuel inside the transition piece 2 and associated complete intermixing are ensured in the case of such a fuel feed.

Figure 4:
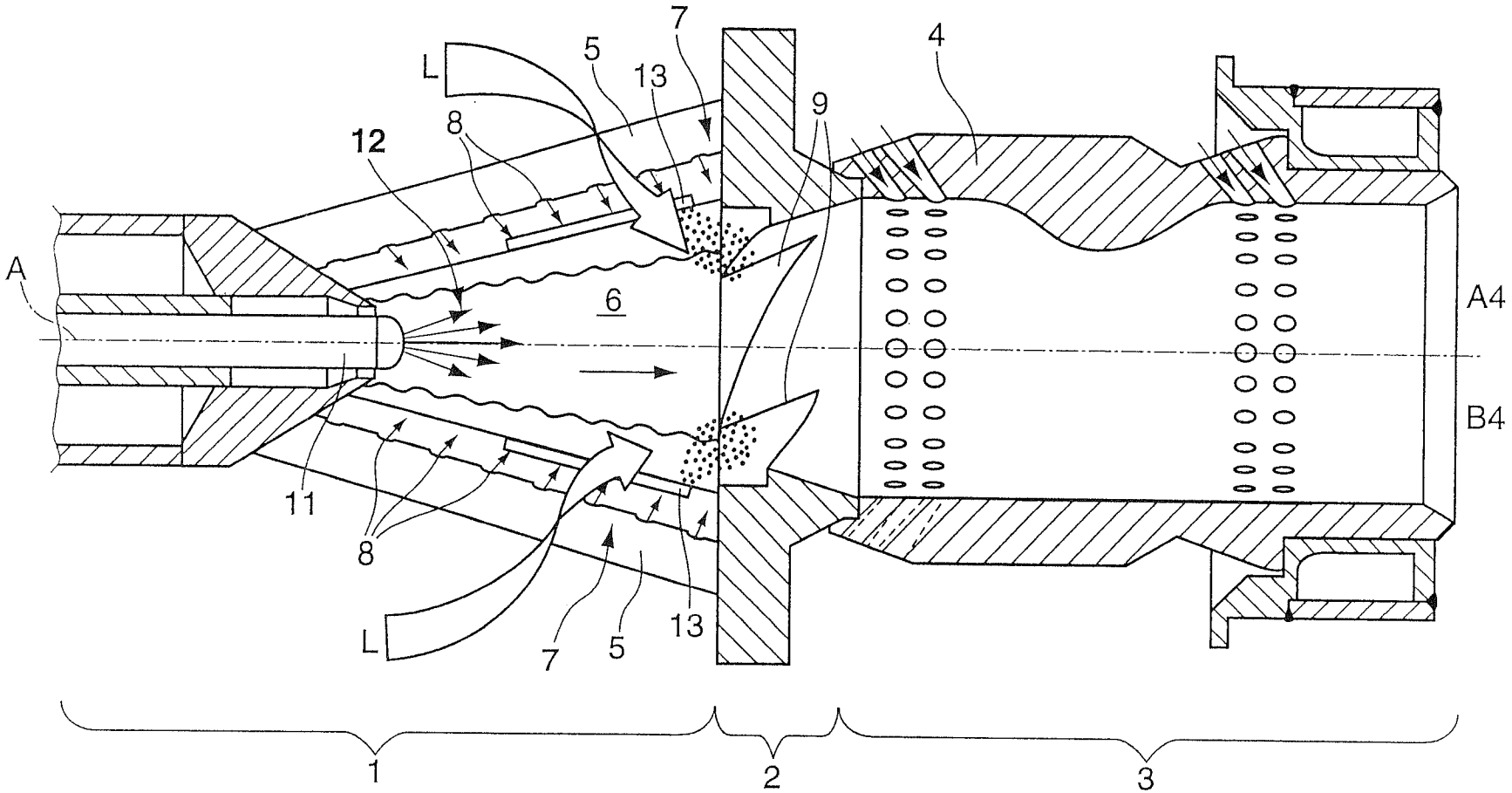
FIG. 4 shows a burner arrangement comparable with FIG. 3, but with liquid-fuel feeds integrated in the swirl generator.

Finally, the exemplary embodiment according to FIG. 4 provides the fuel feed in the region of the premix burner 1. In this case, the fuel feeds 13 are integrated directly upstream of the transition piece 2 in the sectional conical shells 5 of the premix burner 1.

Figure 5:
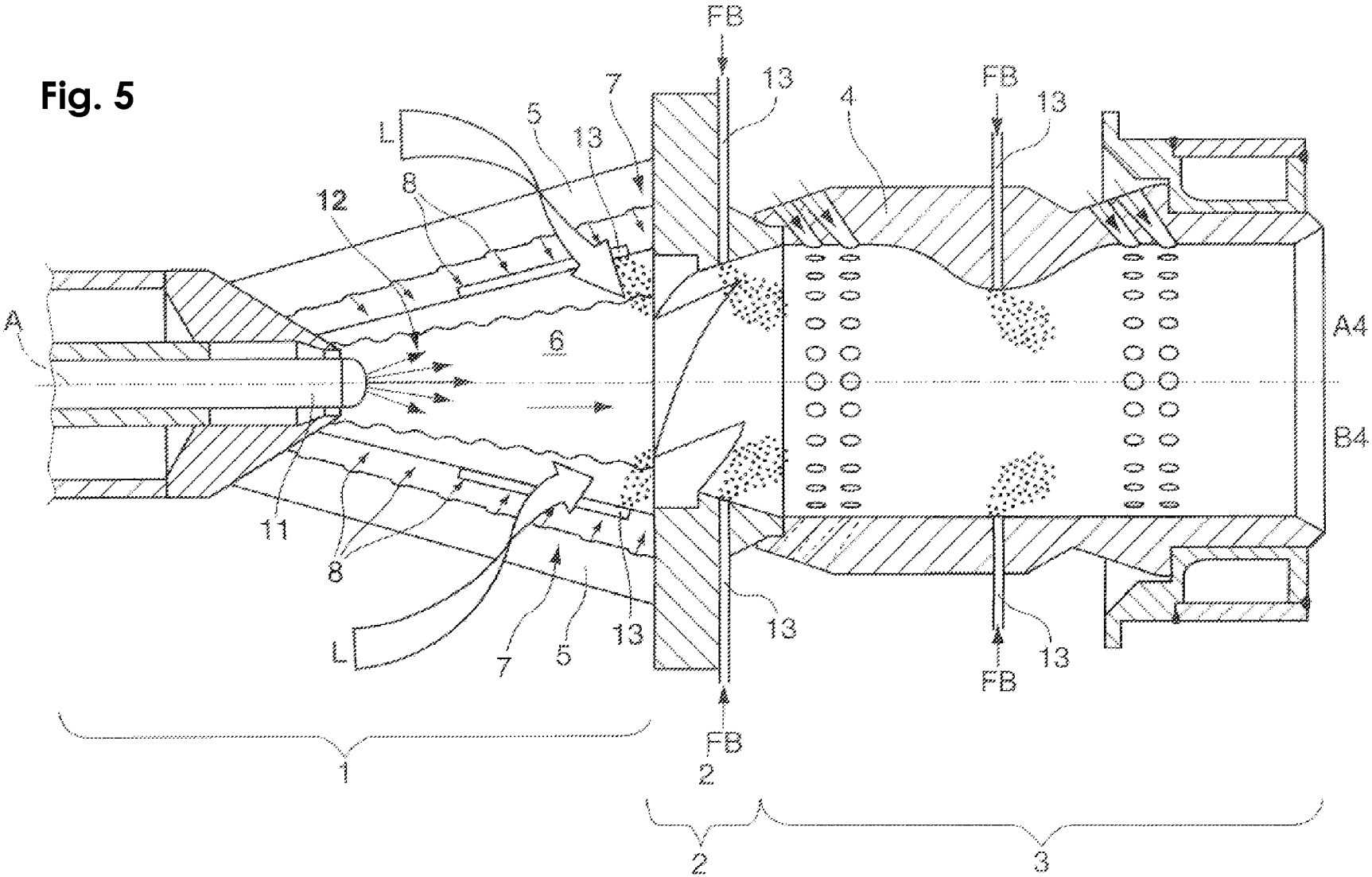
FIG. 5 shows a burner arrangement comparable with FIGS. 1-3, but with a combination of liquid-fuel feeds from the embodiments of FIGS. 1-3 integrated into the arrangement.

In principle, it is possible to combine the different possible arrangements of the further fuel feeds 13 as described in detail with respect to FIGS. 1 to 4, as illustrated in FIG. 5. In all the possible combinations and variations of the further fuel feed, however, it is necessary to pay attention to the fact that the introduction of the fuel into the marginal region of the swirl flow forming inside the burner arrangement is to be carried out in accordance with a fuel distribution forming as uniformly as possible in the cross section of flow in order to avoid as far as possible the occurrence of a fuel gradient along a cross section of the swirl flow.

By measures according to principles of the present invention, of the additional fuel feed, the following advantages can be achieved:

The flame position forming inside the combustion chamber can be stabilized.

Lower emissions with regard to CO, UHC, and $NO_X$ pollutant emissions can be achieved.

Lower combustion chamber pulsations occur, i.e., the stability range within which the burner arrangement can be operated, virtually without vibrations, can be markedly increased.

Due to the more homogeneous fuel distribution within the swirl flow, complete burnout of the fuel inside the combustion chamber is ensured.

In principle, a larger operating range; in particular in burners of a larger type of construction, a more optimum distribution of the fuel is possible.

Measures according to principles of the present invention can lead to a reduction in the atomizing and spraying supply pressure for the fuel operation and provides for improved premixing of the fuel/air mixture.

| List of designations | |
|---|---|
| 1 | Premix burner |
| 2 | Transition piece |
| 3 | Mixing section |
| 4 | Mixing tube |
| 5 | Sectional conical shell |
| 6 | Swirl space |
| 7 | Air-inlet slot |
| 8 | Fuel feed line |
| 9 | Flow guide pieces |
| 11 | Central fuel nozzle |
| 12 | Fuel spray |
| 13 | Fuel feed |
| A | Burner axis |
| L | Combustion air |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A burner arrangement comprising:

a premix burner for a heat generator generating a swirl flow, the premix burner having sectional conical shells which complement one another to form a swirl body, the shells enclosing a conically widening swirl space and mutually defining tangential air-inlet slots;

fuel feeds for at least a first fuel, distributed along the tangential air-inlet slots, the fuel feeds including at least one fuel feed for a second fuel, the at least one fuel feed for a second fuel being arranged along a burner arrangement axis passing centrally through the swirl space;

a transition piece assisting or maintaining the swirl flow directly connected to the premix burner downstream of the swirl body;

a mixing tube directly connected to and downstream of the transition piece, the mixing tube having an axial downstream end; and at least one additional fuel feed positioned centrally in a region of the mixing tube relative to the mixing tube axial downstream end, or upstream of the mixing tube axial downstream end;

wherein the mixing tube is configured and arranged to receive a mixture formed within the premix burner, and wherein the at least one additional fuel feed is configured and arranged to inject fuel into said mixture.

2. The burner arrangement as claimed in claim 1, wherein the at least one additional fuel feed is oriented at an angle $\alpha$, with $90° < \alpha < 180°$, where $\alpha$ constitutes an intersection angle at which the fuel introduced into the swirl space, in the region of the transition piece and/or the mixing tube, intersects the burner arrangement axis.

3. The burner arrangement as claimed in claim 1, wherein the at least one additional fuel feed includes at least two fuel nozzles configured and arranged to discharge fuel while forming a fuel spray.

4. The burner arrangement as claimed in claim 3, wherein the at least two fuel nozzles are arranged axially symmetrically relative to the burner arrangement axis.

5. The burner arrangement as claimed in claim 3, wherein the at least two fuel nozzles lie in a cross-sectional plane which perpendicularly intersects the burner arrangement axis.

6. The burner arrangement as claimed in claim 1, wherein the at least one additional fuel feed is positioned in the region of the swirl body and comprises at least two fuel nozzles arranged symmetrically relative to the burner arrangement axis and which are each integrated in or at the sectional conical shells.

7. The burner arrangement as claimed in claim 1, wherein the at least one additional fuel feed is positioned in the region of the transition piece and comprises at least two fuel nozzles arranged symmetrically relative to the burner arrangement axis and centrally relative to an axial length of the transition piece or upstream thereof.

8. The burner arrangement as claimed in claim 1, wherein the at least one additional fuel feed is positioned in the region of the mixing tube and comprises at least two fuel nozzles arranged symmetrically relative to the burner arrangement axis.

9. The burner arrangement as claimed in claim 8, wherein the mixing tube comprises an axially extending inner wall diffuser contour having a cross section of flow narrowing in the direction of flow, a smallest cross section of flow, and an increasing cross section of flow; and wherein the at least two fuel nozzles are positioned in the region of the smallest cross section of flow.

10. The burner arrangement of claim 1, wherein the at least one additional fuel feed is positioned at the mixing tube wall.

11. The burner arrangement of claim 10, wherein the at least one additional fuel feed defines and axis which intersects a longitudinal axis of the burner.

* * * * *